US009670778B2

(12) United States Patent
Amesoeder

(10) Patent No.: US 9,670,778 B2
(45) Date of Patent: Jun. 6, 2017

(54) ROTARY PISTON ENGINE WHICH ACTS AS A PUMP, CONDENSER OR MOTOR FOR A FLUID

(71) Applicant: Robert Bosch GmbH, Stuttgart (DE)

(72) Inventor: Dieter Amesoeder, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 281 days.

(21) Appl. No.: 14/397,432

(22) PCT Filed: Feb. 20, 2013

(86) PCT No.: PCT/EP2013/053327
§ 371 (c)(1),
(2) Date: Oct. 27, 2014

(87) PCT Pub. No.: WO2013/159946
PCT Pub. Date: Oct. 31, 2013

(65) Prior Publication Data

US 2015/0086407 A1 Mar. 26, 2015

(30) Foreign Application Priority Data

Apr. 25, 2012 (DE) ..... 10 2012 206 797

(51) Int. Cl.
*F01C 3/06* (2006.01)
*F03C 2/24* (2006.01)
(Continued)

(52) U.S. Cl.
CPC ..... *F01C 3/08* (2013.01); *F01C 1/084* (2013.01); *F01C 1/088* (2013.01); *F01C 21/18* (2013.01); *F04C 3/08* (2013.01)

(58) Field of Classification Search
CPC ..... F01C 1/084; F01C 1/088; F01C 21/18; F01C 3/08; F04C 3/08
(Continued)

(56) References Cited

U.S. PATENT DOCUMENTS 3,236,186 A * 2/1966 Wildhaber ..... F01C 3/085 418/150
3,895,610 A * 7/1975 Wahl ..... F01C 9/005 418/49
5,513,969 A 5/1996 Arnold

FOREIGN PATENT DOCUMENTS

DE 102008013991 12/2008
EP 2119869 11/2009
(Continued)

OTHER PUBLICATIONS

International Search Report for Application No. PCT/EP2013/053327 dated Aug. 12, 2013 (English Translation, 2 pages).

*Primary Examiner* — Deming Wan
(74) *Attorney, Agent, or Firm* — Michael Best & Friedrich LLP

(57) ABSTRACT

The invention relates to a rotary piston engine (2) which operates as a pump, condenser or motor for a liquid or gaseous medium. The rotary piston engine (2) has a first gear (4) having a first central axis (I), a second gear (6) arranged opposite the first gear (4) and having a second central axis (II), and a drive shaft (8) having a third central axis (III) and a sliding plane (10, 12) fixedly connected to the drive shaft (8). The first central axis (I) and the second central axis (II) enclose an angle (α3) which is not equal to 180°. The third central axis (III) and at least one central axis (I, II) from the group comprising the first central axis (I) and second central axis (II) enclose an angle (α1, α2) which is not equal to 0° or 90°. The sliding plane (10, 12) and the central axis (I, II) are perpendicular to each other. The first gear (4) has a first end face (14) having a first has toothing (16) that h at least one first tooth (18), and the second gear (6) has a second end face (20) having a second toothing (22) that has at least one second tooth (24), wherein a first number of first teeth and a second number of second teeth differ from each other. The
(Continued)

first tooth (18) and the second tooth (24) engage with each other in such a way that a working chamber (26) is formed by means of a meshing of the teeth (18, 24). A volume formed by means of the at least one working chamber (26) is changed by the meshing of the teeth (18, 24). The at least one working chamber (26) is delimited by a conically shaped inner wall (30) of a housing (28). The at least one working chamber (26) can be connected to a supply flow (40) and an outlet flow (42) for the medium. According to the invention, a component (4, 6) from the group comprising the first gear (4) and second gear (6) is coupled to the housing (28) such that a rotation of the drive shaft (8) causes only the components (4, 6) to tumble. The respective other components (4, 6) from the group comprising the first gear (4) and second gear (6) is coupled to the sliding plane (10, 12) such that the respective other component (4, 6) rotates and tumbles by means of a rotation of the drive shaft (8).

10 Claims, 5 Drawing Sheets

(51) Int. Cl.

| | |
|---|---|
| ***F04C 2/28*** | (2006.01) |
| ***F04C 3/06*** | (2006.01) |
| ***F01C 1/28*** | (2006.01) |
| ***F01C 1/24*** | (2006.01) |
| ***F01C 3/08*** | (2006.01) |
| ***F01C 1/08*** | (2006.01) |
| ***F01C 21/18*** | (2006.01) |
| ***F04C 3/08*** | (2006.01) |

(58) Field of Classification Search
USPC ..... 418/68, 58, 59, 195
See application file for complete search history.

(56) References Cited

FOREIGN PATENT DOCUMENTS

| | | |
|---|---|---|
| WO | 2008110155 | 9/2008 |
| WO | 2011158104 | 12/2011 |
| WO | 2012045876 | 4/2012 |

* cited by examiner

ROTARY PISTON ENGINE WHICH ACTS AS A PUMP, CONDENSER OR MOTOR FOR A FLUID

BACKGROUND OF THE INVENTION

The German patent application DE 42 41 320 A1 discloses a rotary piston engine which operates as a pump, condenser or motor. In said engine, combs of teeth of a rotating drive component for delimiting working chambers run on a cycloid surface of a likewise toothed driven part and thus drive the driven part. The aforementioned working chambers are formed between the teeth of the driven part and the driving part, said working chambers being enlarged or reduced in size for the work thereof during the rotation of the parts in order to generate a feed effect on a gaseous or liquid medium. In order to increase the flow rate of a medium to be condensed, the German patent application proposes to dispose a controller between the driven part and the driving part such that first working chambers are formed between the controller and the driving part and second working chambers are formed between the driven part and the controller, said first working chambers and said second working chambers being opposite one another.

According to the German patent application DE 10 2008 013991 A1 which is also published as the WIPO patent application WO 2008110155 A1, a rotor and a stator are provided in a housing, wherein an oblique sliding plane is disposed between a drive shaft and the rotor. When the shaft is rotated, said oblique sliding plane leads to a tumbling of the rotor or, respectively, a tumbling of the rotor with respect to a rotating of the shaft. In this connection, the stator lying opposite the rotor is not disposed so as to co-rotate and thus in a stationary manner in a housing that accommodates the rotor and the stator.

In a rotary piston engine having a tumbling rotor, it has however been shown that the working chambers cannot be completely filled due to the fact that a supply flow and an outlet flow can only be disposed in a limited region. It has furthermore been shown that the intake and discharge openings can often only be designed very small, so that the medium to be conveyed achieves high speeds and thus enables undesired pressure peaks to occur.

SUMMARY OF THE INVENTION

There is a need to provide a rotary piston engine which comprises a rotor that can be induced to tumble by means of a rotating oblique gliding plane and in which the working chambers can be better filled.

According to a first exemplary embodiment of the invention, provision is made for a rotary piston engine which operates as a pump, condenser or motor for a liquid or gaseous medium. The rotary piston engine has a first gear having a first central axis, a second gear arranged opposite the first gear and having a second central axis and a drive shaft having a third central axis and a sliding plane fixedly connected to the drive shaft. The first central axis and the second central axis enclose an angle which is not equal to 180°. The third central axis and at least one central axis from the group comprising the first central axis and the second central axis enclose an angle which is not equal to 0° or 90°. The first sliding plane and the central axis are perpendicular to each other. The first gear has a first end face having a first toothing that has at least one first tooth, and the second gear has a second end face having a second toothing that has at least one second tooth, wherein a first number of first teeth and second number of second teeth differ from each other. The first tooth and the second tooth engage with each other in such a way that at least one working chamber is formed by means of a meshing of the teeth. A volume formed by means of the at least one working chamber is changed by the meshing of the teeth. The at least one working chamber is delimited by a spherically shaped inner wall of a housing. The at least one working chamber can be connected to a supply flow and an outlet flow. A component from the group comprising the first gear and the second gear is coupled to the housing such that a rotation of the drive shaft causes only the component to tumble. The respective other component from the group comprising the first gear and the second gear is coupled to the first sliding plane such that said respective other component rotates and tumbles by means of a rotation of the drive shaft.

By virtue of the fact that the stator known from the German patent DE 10 2008 013991 A1 is no longer stationary but tumbles with respect to a housing, the area is enlarged on which the supply flows and the outlet flows can be arranged. The tumbling movement particularly enables more than one supply flow and outlet flow to be provided for the medium. As a rule, so many supply flows and outlet flows can be extensively disposed on the housing as the gear having the least number of teeth has teeth. In this regard, the first number can, for example, comprise only one first tooth and the second number two or more second teeth, and vice-versa. Furthermore, the number of supply flows can be equal to the number of outlet flows. The supply and outlet flows can thereby be extensively disposed so as to be uniformly distributed in an alternating manner. As a result of the greater number of supply and outlet flows as well as of a different configuration of the same with respect to the prior art, high speeds or pressure peaks in the medium can be prevented. The degree to which the working chambers can be filled can also be increased. For example, the second gear can be encompassed by the spherical, in particular hemispherical, inner wall of the housing and thereby be supported on the inner wall of the housing. The first gear can, for example, be induced to rotate and/or tumble by means of the sliding plane. The second gear is induced to carry out a tumbling movement by means of the tumbling movement of the first gear. The second gear can be connected to the housing or, respectively, the inner wall in such a manner that a relative rotation of the second gear with respect to the housing, respectively the first gear, is prevented. As a rule, the first gear and the second gear have in each case a number of teeth which is different from one another by at least one tooth. A trochoidal toothing has particularly proved to be effective for such an embodiment. A radial delimitation of the working chambers towards the inside can take place by means of spherical elements that are disposed on the gears. As a result of the spherical inner wall, the working chamber as well as the first gear and the second gear are sealed off towards the outside with respect to the surrounding environment. As a rule, the inner wall of the housing is of hemispherical shape. This allows the first gear, the second gear and the drive shaft to be easily mounted. The sliding plane can, for example, support the first gear in such a way that the first gear is held in position if the volume of the at least one working chamber is reduced and the first and the second gear are thereby loaded axially in opposite directions. The second gear is thereby supported by the housing.

According to a further exemplary embodiment of the invention, the at least one working chamber is delimited radially inwards by a common contact surface that is shaped spherically in the first gear and in the second gear.

A fluid located in the working chambers is sealed off from the surrounding environment during the tumbling movement by means of the spherically shaped contact surface. As a result, high pressures due to the changing volumes of the working chambers can be generated during the tumbling motion.

According to a further exemplary embodiment of the invention, the first central axis and the third central axis enclose a first angle. The second central axis and the third central axis enclose a second angle. The first angle and the second angle are not equal to 0° or 90°.

The first gear as well as the second gear is induced to tumble by such an arrangement. In one exemplary embodiment, the first angle can be 5° and the second angle 20°. The first angle and the second angle can also be the same size. The first central axis and the second central axis can be skewed to one another. Furthermore, the first central axis and the second central axis can span a second plane. The first plane and the second plane can enclose an angle which is not equal to 0° or 180°. The first plane and the second plane can also be congruent.

According to a further exemplary embodiment of the invention, the first central axis and the third central axis span a first plane and the second central axis and the third central axis span a second plane. The first plane and the second plane are perpendicular to one another.

The first plane and the second plane can, of course, assume any angle to one another.

According to a further exemplary embodiment of the invention, the first central axis and the second central axis lie in a common plane.

According to a further exemplary embodiment of the invention, the first angle, starting from the third central axis, rotates counterclockwise and the second angle, starting from the third central axis, rotates clockwise.

Such an arrangement ensures that the torques occurring during the tumbling motion of, for example, the second gear and the rotary and tumbling motion of the first gear mutually reduce one another. By appropriately selecting the first and the second angle as well as an appropriate first mass of the first gear and a second mass of the second gear, it is possible that torques occurring during the rotational movement of the drive shaft cancel each other out, so that the housing of the rotary piston engine does not have to be additionally supported.

According to a further embodiment of the invention, a second sliding plane is fixedly connected to the drive shaft. The second sliding plane and the second central axis are perpendicular to each other. The first gliding plane and the first gear can be rotated relative to one another and are connected to one another. The second sliding plane and the second gear can be rotated relative to one another and are connected to one another.

The operational reliability of the rotary piston engine can be increased by means of connecting the sliding plane to the second gear so that said plane and said gear can rotate relative to one another. This is due to the fact that the second gear and the second sliding plane are forcibly set into a tumbling motion. By means of such an arrangement, the first gear and the second gear can be positively guided into connection with the spherical inner wall of the housing. Stiffness during the meshing of the gears can thus be prevented, said stiffness resulting possibly from the manufacturing tolerances of the gears.

According to a further exemplary embodiment of the invention, the first central axis, the second central axis and the third central axis intersect at a common point, the common point being the central point of a diameter of the inner wall.

Of course, a diameter of the spherically shaped contact surface also intersects the third central axis at the common point. In so doing, it can be ensured that no translational movements occur between the individual parts, which can lead to a great deal of wear.

According to a further exemplary embodiment of the invention, the first sliding plane and the second sliding plane intersect the common point.

This can have the result that the sliding plane and the associated gear move past each other in a circular path, however at different speeds. Particularly if a roller bearing, for example an axial bearing, is disposed between the sliding plane and the associated gear, the durability of the rotary piston engine is increased by a translational movement by the gear and the sliding plane being prevented.

According to a further exemplary embodiment of the invention, the first gliding plane and/or the second gliding plane do not intersect the common point.

As a result, a translational movement occurs in addition to the rotatory movement between the sliding plane and the associated gear. A scoring of the gliding plane, respectively of the gear, can be prevented by the translational movement. This results from the fact that the gear and the associated sliding plane again assume the initial positions thereof only after a predetermined number of revolutions due to the different rotational speeds of the gear and the associated sliding plane.

According to a further exemplary embodiment, the second gear is coupled in a rotationally fixed manner to the housing. A stud is fixedly connected to an outer wall of the second gear. The stud is guided in a groove shaped recess in the inner wall, said recess being circular in shape.

Due to the forces acting on the second gear during the compression process on the teeth of the gears, the stud which generally has a cylindrical shape is pressed against the circular recess. The recess can, of course, also be shaped as a circular groove; thus enabling said groove to serve as a connecting link for the stud. The stud in combination with the circular recess can be designed as a fixation of the second gear to the housing so that a rotational movement of the second gear is hereby prevented. The circular recess in combination with the stud can therefore only ensure the tumbling motion of the second gear.

According to a further exemplary embodiment, the first gear is coupled to the housing in a rotationally fixed manner.

The first gear can, for example, be fixed to the housing by means of a stud protruding in the radial direction in combination with a groove configured on the inner wall, respectively the housing. In so doing, the first gear can in fact tumble but can however not rotate. In such a configuration, the second gear will normally likewise tumble and will also normally rotate.

According to a further exemplary embodiment of the invention, the stud extends along a fourth central axis.

The circular recess in the inner wall does not require an undercut. Thus, the stud as well as the inner wall of the housing can be cost effectively manufactured as a plastic injection molded part.

According to a further exemplary embodiment of the invention, a component from the group of at least one first tooth and at least one second tooth of the rotary piston engine has a recess, so that an overlap with the supply flow and/or the outlet flow takes place in a predetermined angle of rotation range of the at least one component.

As a result of such a configuration, the period of time in which the medium is supplied to the working chamber or the medium is removed from the working chamber can be increased. A higher degree of filling of the working chamber can thereby be implemented with medium. The recess can be formed on one tooth flank or on both tooth flanks of a tooth. The recesses on both tooth flanks can also be different from one another. The individual supply flows and/or outlet flows can also be connected to one another. The supply flows can also be connected to the outlet flows in order, for example, to increase the pressures to be achieved by such a rotary piston engine. The supply flows and outlet flows can, of course, be controlled by means of valves, in particular solenoid valves.

According to a further exemplary embodiment of the invention, at least one component from the group consisting of first tooth, second tooth, first sliding plane, second sliding plane, inner wall and outer wall comprises a recess for accommodating lubricants.

The friction between individual components can be reduced by means of lubricants; thus enabling the theoretical service life of the rotary piston engine to thereby be extended.

According to a further exemplary embodiment of the invention, the first toothing and the second toothing are selected from the group consisting of helical toothing, involute toothing, cycloidal toothing and herringbone toothing.

According to a further exemplary embodiment of the invention, a bearing element between the sliding plane and the associated gear can be designed as a lubricated, hydraulically or pneumatically supported friction bearing. In addition, the bearing element can be designed as an anti-friction bearing, for example as a roller bearing or as another type of bearing according to the prior art.

According to a further exemplary embodiment of the invention, the rotary piston engine described above can be used as a transmission.

It should be noted that the concepts underlying the invention are discussed in this application in connection with a rotary piston engine. It is clear to the person skilled in the art that the individually described features can be combined with each other in different ways in order to arrive at other embodiments of the invention.

BRIEF DESCRIPTION OF THE DRAWINGS

Embodiments of the invention are described below with reference to the attached drawings. The figures are only schematically depicted and are not true to scale.

DETAILED DESCRIPTION

Figure 1:
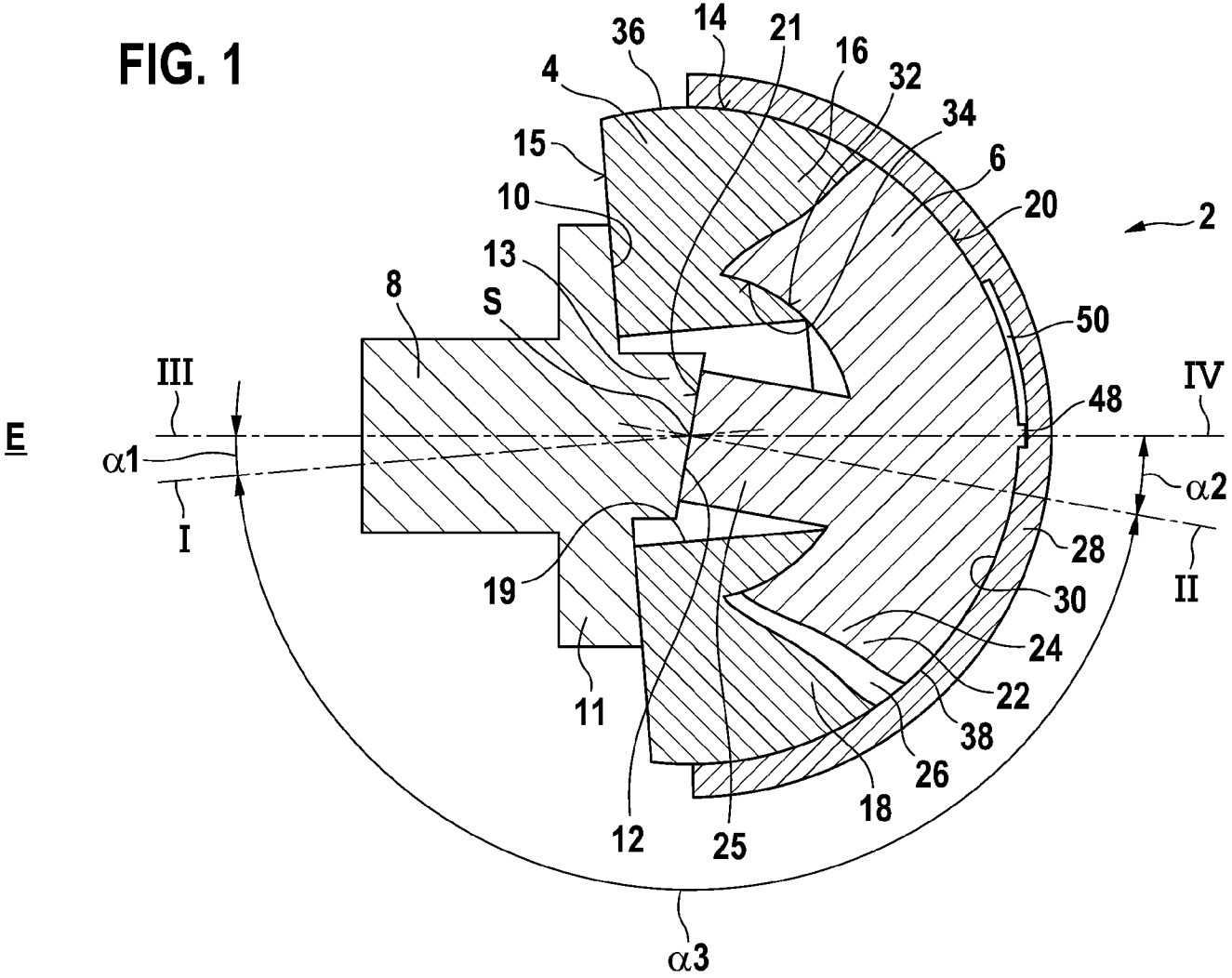
FIG. 1 shows a rotary piston engine in longitudinal cross section.

FIG. 1 shows a rotary piston engine 2 which operates as a pump, condenser or motor for a liquid or gaseous medium. The rotary piston engine 2 has a first gear 4 having a first central axis I, a second gear 6 arranged opposite the first gear 4 and having a second central axis II, and a drive shaft 8 having a third central axis III. The drive shaft 8 has a disc element 11 which has a first sliding plane 10 on the side thereof facing the first gear 4. The drive shaft 8 has an axle section 13 on the disc element 11, said axle section being arranged concentrically to the third middle axis III. A second sliding plane 12 is formed on the axle section 13 on the side thereof facing the second gear 6. The disc element 11 can, of course, be designed in such a way that the axle section 13 is rendered unnecessary. The first gear 4 has a first sliding surface 15 which is connected to the first sliding plane 10 of the drive shaft 8. Opposite to the first sliding surface 15, the first gear 4 has a first end face 14 on which a first toothing 16 having at least one first tooth 18 is formed. In addition, the first gear 4 has an opening 19 along the first central axis I, in which opening the axle section 13 protrudes. The axle section 13 comprising the second sliding plane 12 is connected to a second sliding surface 21 of the second gear 6. Opposite the second sliding surface 21, a second end face 20 is formed on the second gear 6, on which end face a second toothing 22 comprising at least one tooth 24 is formed. An axle end 25 extends from the second toothing 22 along the second middle axis II towards the axle section 13 and is delimited by the second sliding surface 21. Of course, the axle section 13 can be designed in such a way that the axle end 25 can be rendered unnecessary. As can be better seen in FIG. 2, a working chamber 26 is formed by means of a meshing of the at least one first tooth 18 and the at least one second tooth 24, wherein a volume formed by means of the working chamber 26 is changed by the meshing of the teeth 18, 24. The first gear 4 and the second gear 6 are surrounded by a housing 28 comprising a spherically, in this case hemispherically, shaped inner wall 30. Said spherical inner wall 30 seals the working chamber 26 off towards the outside. The first gear 4 has a spherical first outer wall 36 which corresponds to the spherical inner wall 30 and rests sealingly against said inner wall 30. The second gear 6 has a spherical second outer wall 38, wherein the outer wall 38 likewise corresponds to the spherical inner wall 30. In addition, a spherical first contact surface 32 is formed in the first gear 4, which sealingly rests against a corresponding second contact surface 34 which is formed on the second gear and has the shape of a hollow sphere. The working chamber 26 is therefore delimited by the two toothings 16, 22, by the spherical inner wall 30 as well as by the spherical first contact surface 32 in combination with the second contact surface 34 having the shape of a hollow sphere. In addition, a stud 48 is formed on a second outer wall 38, said stud engaging in a circular recess 50 formed on the spherical inner wall 30 of the housing 28. The circular recess 50 can also be designed as a circular ring. The first central axis I of the first gear 4, on which axis the first sliding plane 10 is perpendicularly disposed, intersects the third central axis III of the drive shaft 8 at a common point S. The second central axis II of the second gear 6 intersects the third central axis III of the drive shaft 8 likewise at this common point S. Furthermore, the spherical inner wall 30 extends along a diameter D which likewise intersects the third central axis III at the common point S. The first central axis I and the third central axis III enclose a first angle $\alpha 1$ which, beginning at the third central axis III, extends in a counterclockwise direction. The first angle $\alpha 1$ is 5° in the exemplary embodiment presented here. Furthermore, the third central axis III and the second central axis II enclose an angle $\alpha 2$. The angle thereby extends from the third central axis III in the clockwise direction and is 10° in the exemplary embodiment presented here. Of course, the two angles α1 and α2 can also have other values, in particular can assume values that lie between 5° and approximately 25°. The first central axis I and second central axis II enclose a third angle α3 which is not equal to 180°. In addition, the first I, the second II and the third III central axis span a common plane E. By virtue of the fact that the first central axis I, the second central axis II and the third central axis III lie in a plane and that the two angles α1, α2 extend in opposite directions, the torques produced by the first gear 4 during the operation of the rotary piston engine 2 are reduced by the amount of the torques produced by the second gear 6. It is therefore possible by a selection of the materials of the first gear 4 and of the second gear 6 as well as by a corresponding selection of the two angles α1, α2 that these torques cancel each other out and the housing is thereby torque-free. Of course, the third central axis III and the first central axis I could span a first plane, and the third central axis III and the second central axis II could span a second plane, wherein the two planes could be disposed at any desired angle to each other. The second toothing 22 of the second gear 6 is furthermore formed in such a way that the second end face 20 and the spherical second outer wall 38 of the second gear 6 coincide. In the present exemplary embodiment, the first sliding plane 10 does not intersect the third central axis III at the common point S. Thus, a translational movement occurs in addition to the rotatory relative movement between the first sliding plane 10 of the drive shaft 8 and the first gliding surface 15 of the first gear 4 during a rotation of the drive shaft 8. Precisely the translational movement can prevent a roping or scoring of the first sliding plane 10 and/or of the first sliding surface 15. In contrast hereto, the second sliding plane 12 intersects the third central axis III at the point S. Only a rotatory relative movement correspondingly occurs between the second sliding plane 12 of the drive shaft 8 and the second sliding surface 21 of the second gear 6.

Figure 2:
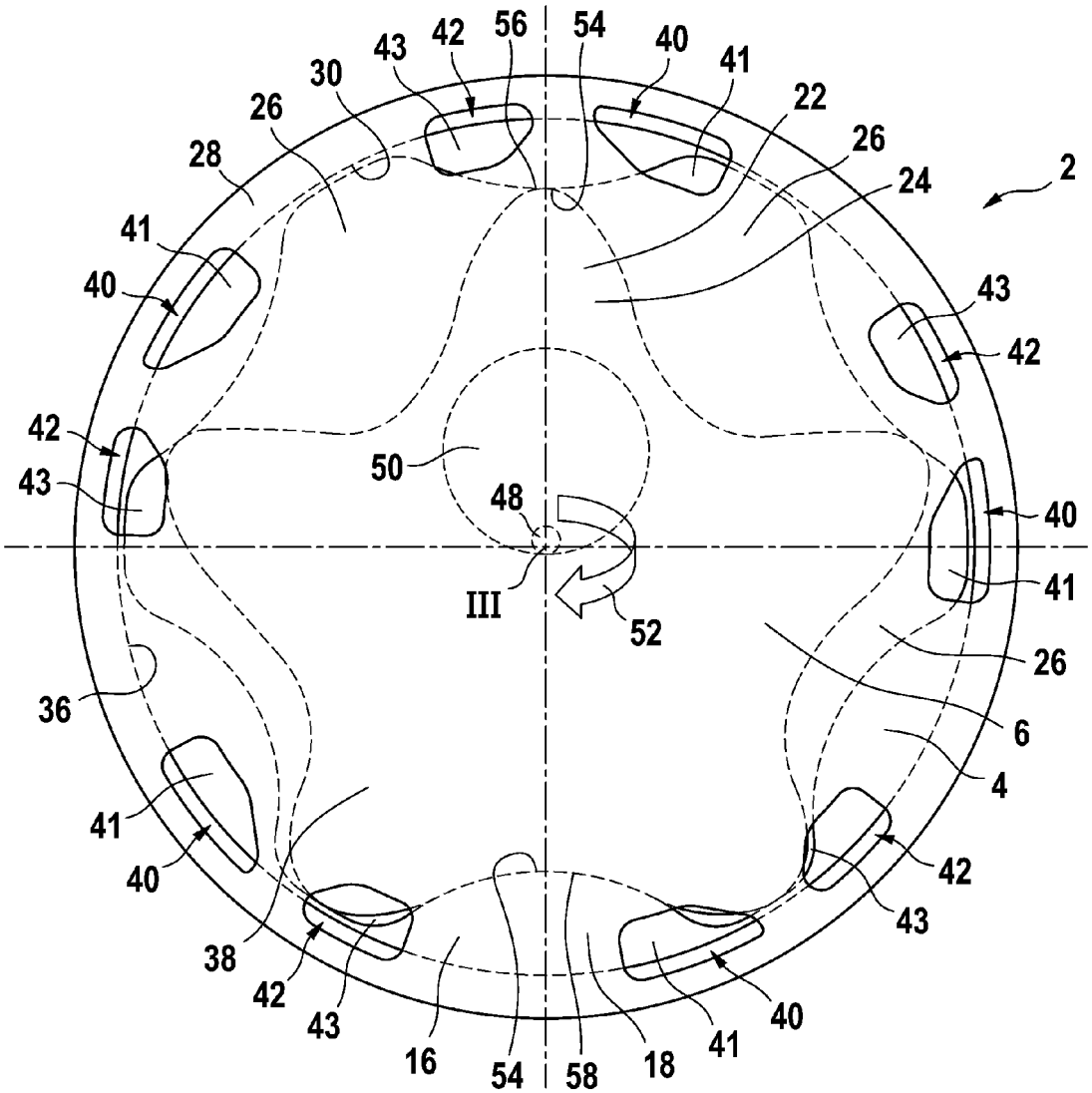
FIG. 2 shows the rotary piston engine known from FIG. 1 as seen in an X-ray type view.

FIG. 2 shows the rotary piston engine 2 known from FIG. 1 in an X-ray type view. It can be seen in this view that the second gear 6 has five second teeth 24 and the first gear has six first teeth 18. In addition, the housing has five supply flows 40 and five outlet flows 42 uniformly distributed over the periphery. The number of supply flows 40, respectively of outlet flows 42, corresponds hereby to the number of the second teeth 24 of the second gear 6. A supply control channel 41 is formed at each supply flow 40 and an outlet control channel 43 is formed at each outlet flow 42. It can furthermore be seen in FIG. 2 that the spherical recess 50 is formed eccentrically to the third central axis III. The drive shaft 8 rotates clockwise in the direction of the arrow 52.

By rotating the drive shaft 8 in the direction of the arrow 52, the first gear 4 is induced to rotate and tumble relative to the second gear 4 by the first sliding plane 10 which is disposed perpendicularly on the first central axis I. The second gear 6 is induced solely to tumble about the second central axis II by means of the meshing of the first teeth 18 and the second teeth 24. Due to the forces acting in the working chambers by means of the condensing of the medium as well as to the meshing of the teeth 18, 24, the second sliding surface 2 in combination with the second sliding plane 12 can be rendered unnecessary. It should be noted that the rotational speed of the first gear 4 and the rotational speed of the drive shaft 8 are different from each other. The exclusive tumbling movement, i.e. without additional rotational movement, of the second gear 6 takes place as a result of the positive guiding of the stud 48 in the circular recess 50. As can further be seen in FIG. 2, a tooth crest 54 of the first tooth 18 and a tooth crest 56 of the second tooth 24 are disposed opposite one another at the 12 o'clock position, wherein the tooth crest 54 of the first tooth 18 and the tooth crest 56 of the second tooth 24 touch and adjacent working chambers 26 are thereby sealed off from one another. At the 6 o'clock position, the tooth crest 54 of the first tooth 18 engages in a tooth base of the second tooth 24. It should be noted that the toothing relates to a trochoidal toothing, in which working chambers 26 adjacent to one another are sealed off from one another during a relative movement of the first gear 4 to the second gear 6. As a result of the meshing of the teeth 18, 24 and the volumes of the working chambers that have been changed by the meshing, medium is drawn through the supply flow 40 into the working chamber 26, condensed and then pressed out of the outlet flow 42 that is adjacent to the supply flow 40 in the rotational direction 52 of the drive shaft 8. It can be seen in the selected depiction that the working chambers 26 extending between the 12 o'clock position and the 6 o'clock position are connected to the supply flows 40, whereas the working chambers 26 situated between the 6 o'clock position and the 12 o'clock position do not have a connection to a supply flow 40.

Figure 3:
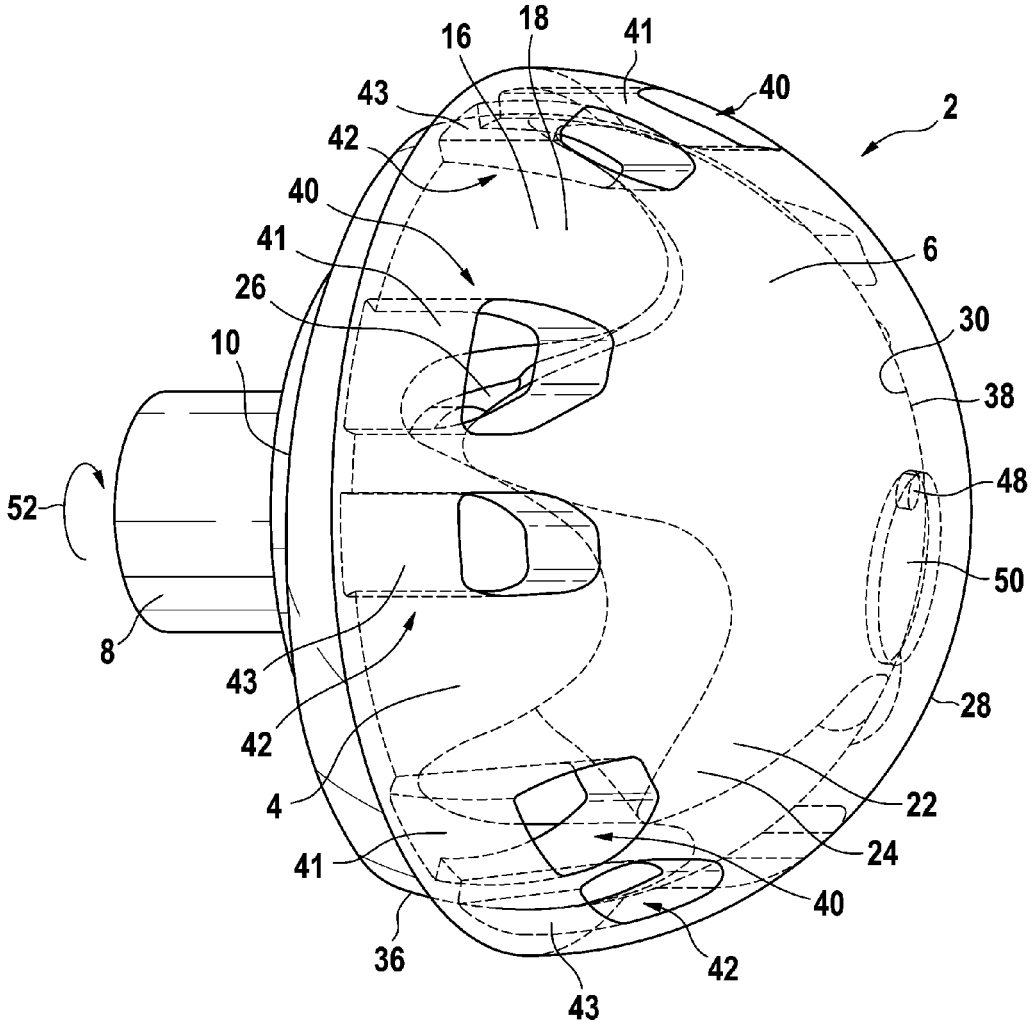
FIG. 3 shows the rotary piston engine known from FIG. 1 in a three dimensional X-ray type view.

FIG. 3 shows the rotary piston engine 2 known from FIG. 1 in a three dimensional X-ray type view. In this view, the design of the supply flow control channels 41 and the outlet flow control channels 43 are easily recognizable. In this connection, the supply flow control channels 41, respectively the outlet flow control channels 43, are configured in such a way that the medium to be supplied fills the working chamber 26 preferably to 100% and the condensed medium is discharged through the outlet flow 42 preferably to 100%. In particular if the medium is gaseous and therefore compressible, a volume flow of the medium to be transported as well as a pressure to be achieved is decisively influenced by the degree of filling of the working chambers 26. The opening 19 of the first gear 4 is thereby configured in such a manner that the axle section 13 of the drive shaft 8 as well as the axle end 25 of the second gear 6 do not collide with the first gear 4 when said first gear 4 is tumbling.

Figure 4:
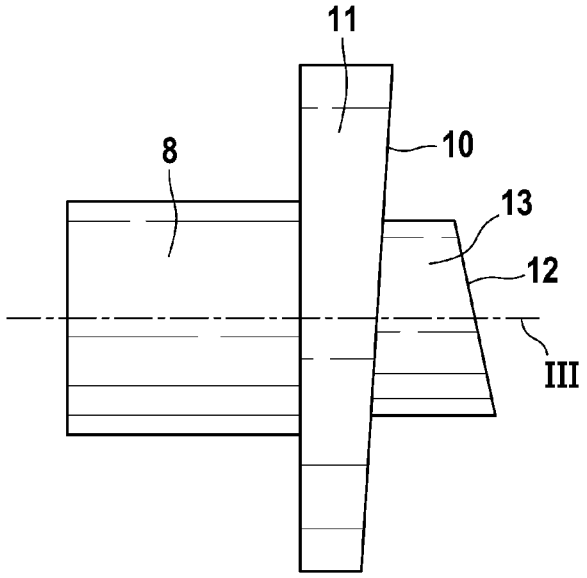
FIG. 4 shows a drive shaft from the rotary piston engine known from FIG. 1 in a side view.

FIG. 4 shows the drive shaft 8 of the rotary piston motor 2 known from FIG. 1.

Figure 5:
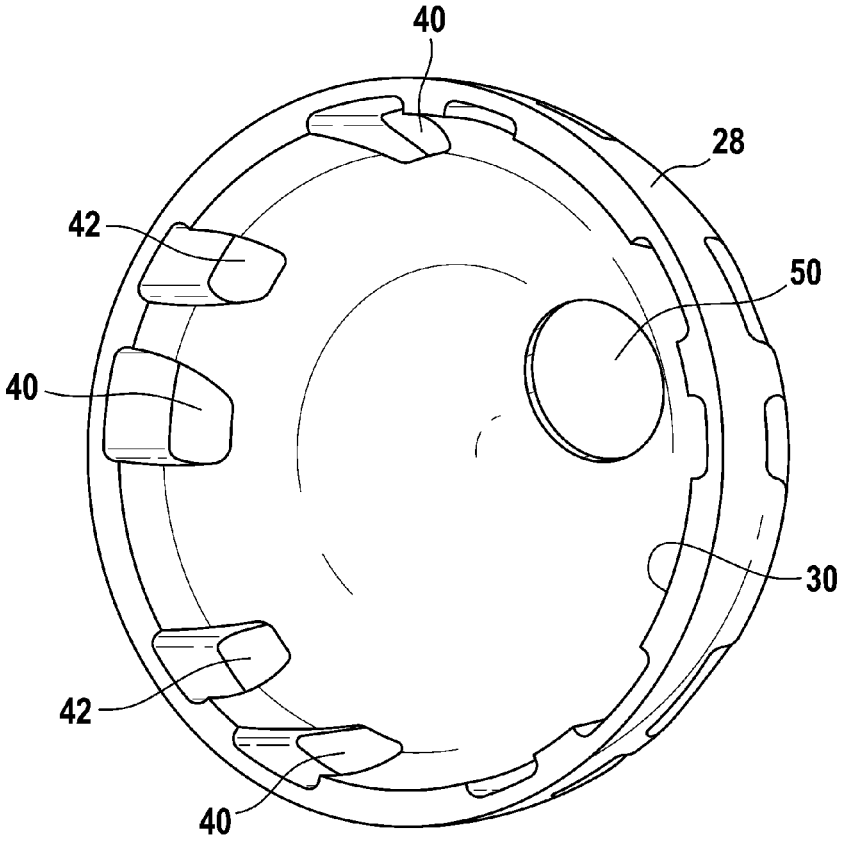
FIG. 5 shows a housing comprising an inner wall from the rotary piston engine known from FIG. 1 in a 3D view.

FIG. 5 shows the housing 28 of the rotary piston engine 2 known from FIG. 1 with a view onto the spherical inner wall 30. The supply flows 40 and the outlet flows 42 can clearly be seen as apertures through the housing 28. In addition, the circular, eccentrically arranged recess 50 can be seen.

Figure 6:
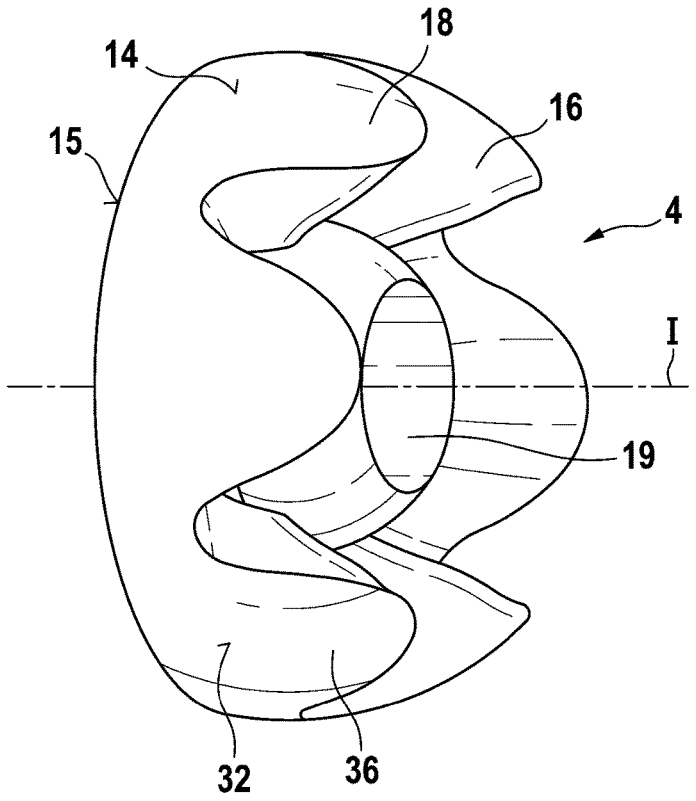
FIG. 6 shows a first gear from the rotary piston engine known from FIG. 1 in a 3D view.

FIG. 6 shows the first gear 4 from the rotary piston engine 2 known from FIG. 1. The shape of the first toothing 16 as well as the circular first contact surface 32 comprising the opening 19 is clearly visible here.

Figure 7:
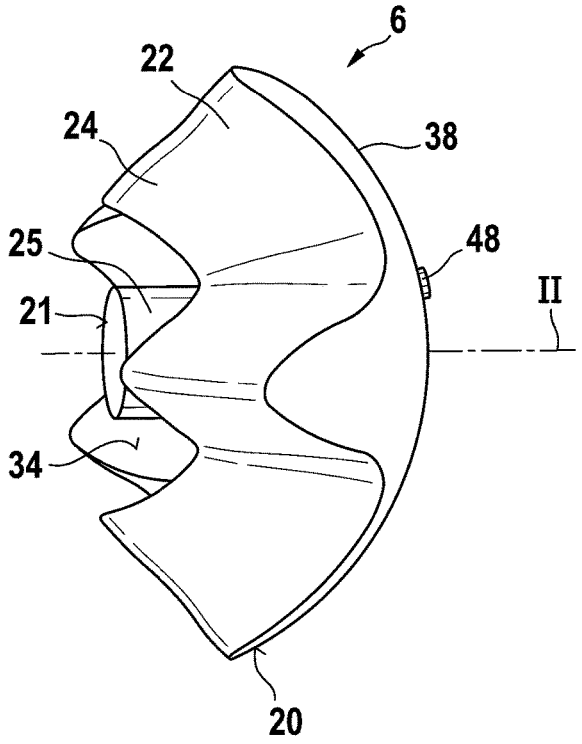
FIG. 7 shows a second gear from the rotary piston engine known from FIG. 1 in a 3D view.

FIG. 7 shows the second gear 6 from the rotary piston engine 2 known from FIG. 1 in a 3D view. It is clearly visible here that the toothing 22 extends up to the spherical second outer wall 38 and therefore the second end face 20 is formed by this second outer wall 38. In addition, the second contact surface 34, which is in the shape of a hollow sphere and corresponds to the spherical first contact surface 32 of the first gear 4, is clearly visible.

In addition, the first gear 4, the second gear 6, the drive shaft 8 as well as the housing 28 are in each case formed in one piece as a plastic injection molded part. As a result, the individual parts can be cost effectively manufactured in large quantities.

What is claimed is:

1. A rotary piston engine which operates as a pump, condenser or motor for a liquid or gaseous medium, the rotary piston engine comprising a first gear having a first central axis, a second gear arranged opposite the first gear and having a second central axis, and a drive shaft having a third central axis, and the drive shaft having sliding planes, wherein the first central axis and the second central axis together enclose an angle ($\alpha$3) which is not equal to 180°, wherein the third central axis (III) and one of the first or second central axes together enclose an angle ($\alpha$I, $\alpha$2) which is not equal to 0° or 90°, wherein one of the first or second central axes is perpendicular to one of the sliding planes, wherein the first gear has a first end face having a first toothing that has at least one first tooth and the second gear has a second end face having a second toothing that has at least one second tooth, wherein a first number of first teeth and a second number of second teeth differ from each other, wherein the first tooth and the second tooth engage with each other in such a way that a working chamber is formed by means of a meshing of the first teeth and the second teeth, wherein a volume formed by means of the at least one working chamber is changed by the meshing of the first teeth and the second teeth, wherein the at least one working chamber is delimited by a spherically shaped inner wall of a housing, wherein the at least one working chamber is configured to be connected to a supply flow and an outlet flow for the medium, characterized in that one of the first gear or the second gear is coupled to the housing such that rotation of the drive shaft causes the one of the first gear or the second gear to tumble but not rotate, also characterized in that the other of the first gear or the second gear is in contact with one of the sliding planes such that the other of the first gear or the second gear rotates and tumbles simultaneously by means of rotation of the drive shaft.

2. The rotary piston engine according to claim 1, characterized in that the first central axis and the third central axis enclose a first angle, $\alpha$1, wherein the second central axis and the third central axis enclose a second angle, $\alpha$2, wherein the first angle ($\alpha$I) and the second angle ($\alpha$2) are not equal to 0° or 90°.

3. The rotary piston engine according to claim 2, characterized in that the first central axis and the second central axis lie in a common plane.

4. The rotary piston engine according to claim 2, characterized in that, starting from the third central axis, the first angle rotates counterclockwise and the second angle rotates clockwise.

5. The rotary piston engine according to claim 1, characterized in that the sliding planes comprises a first sliding plane and a second sliding plane, wherein the first sliding plane and the first gear are configured to be rotated relative to one another and are in contact with one another, wherein the second sliding plane perpendicular to the second central axis, wherein the second sliding plane and the second gear are configured to be rotated relative to one another and are in contact with one another.

6. The rotary piston engine according to claim 5, characterized in that the first central axis, the second central axis and the third central axis (III) intersect at a common point, wherein the common point is a central point of a diameter of the inner wall.

7. The rotary piston engine according to claim 6, characterized in that the first sliding plane and the second sliding plane intersect the common point.

8. The rotary piston engine according to claim 6, characterized in that at least one of the first sliding plane and the second sliding plane do not intersect the common point.

9. The rotary piston engine according to claim 1, characterized in that the second gear is fixedly coupled to the housing, wherein a stud is fixedly connected to an outer wall (38) of the second gear (6), the stud being guided in a recess in the inner wall, the recess being circular.

10. The rotary piston engine according to claim 1, characterized in that at least one tooth from the group of gear teeth comprising at least one first tooth and at least one second tooth has a recess; thus enabling an overlap with at least one of the supply flow and the outlet flow to take place in a predetermined rotation angle range of the at least one tooth.

* * * * *